US006310594B1

(12) United States Patent
Libsch et al.

(10) Patent No.: US 6,310,594 B1
(45) Date of Patent: Oct. 30, 2001

(54) DRIVING METHOD AND CIRCUIT FOR PIXEL MULTIPLEXING CIRCUITS

(75) Inventors: Frank R. Libsch, White Plains; Kai R. Schleupen, Yorktown Heights, both of NY (US); Robert L. Wisnieff, Ridgefield, CT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/186,015

(22) Filed: Nov. 4, 1998

(51) Int. Cl.[7] ..... G09G 3/36

(52) U.S. Cl. ..... 345/90; 345/98; 345/100; 345/214

(58) Field of Search ..... 345/94, 98, 99, 345/90, 100, 102, 85, 205, 88, 89, 95, 96, 211, 212, 213, 210, 214; 349/42, 33, 143; 359/59, 54, 55

(56) References Cited

U.S. PATENT DOCUMENTS

| | | | |
|---|---|---|---|
| 4,870,399 | 9/1989 | Shields . | |
| 5,120,964 | 6/1992 | Wieczorek . | |
| 5,175,446 | 12/1992 | Stewart . | |
| 5,333,004 | 7/1994 | Mourey et al. . | |
| 5,471,225 | 11/1995 | Parks . | |
| 5,641,974 | 6/1997 | den Boer et al. . | |
| 5,729,316 * | 3/1998 | Yamamura et al. | 349/150 |
| 5,828,429 | 10/1998 | Takemura . | |
| 5,877,514 * | 3/1999 | Seo | 257/72 |
| 5,929,958 * | 7/1999 | Ohta et al. | 349/141 |
| 6,064,459 * | 5/2000 | Lee | 349/139 |

FOREIGN PATENT DOCUMENTS

| | | |
|---|---|---|
| 506530 A1 | 9/1992 | (EP) . |
| 6202077 | 7/1994 | (JP) . |
| 1054998 | 2/1998 | (JP) . |

* cited by examiner

*Primary Examiner*—Bipin Shalwala
*Assistant Examiner*—Mansour M. Said
(74) *Attorney, Agent, or Firm*—F. Chau & Associates, LLP

(57) ABSTRACT

A driving method for multiplexing pixels in active matrix displays in accordance with the present invention includes the steps of providing a plurality of pixels arranged in an array, wherein each pixel includes at least two transistors associated therewith, the transistors disposed in the array of pixels and each pixel including a plurality of control lines for controlling the transistors for turning each pixel on and off and sequencing waveforms on the control lines to provide multiplexing at the pixels in the array. A circuit for addressing pixels in a pixel array in accordance with the present invention includes at least two transistors associated with each pixel, the transistors disposed in the array of pixels. A plurality of control lines associated with each pixel for controlling the transistors of each pixel. At least one gate driver sequences waveforms on the control lines to provide multiplexing at the pixels in the array.

26 Claims, 14 Drawing Sheets

FIG. 4

| FIG. 4A |
|---|
| FIG. 4B |

FIG. 4A

| | | driver chips outputs for inner loop [Row #] | | | | | | | | driver chips outputs for outer addr. loop [En(ables)] | | | | | | | | |
|---|---|---|---|---|---|---|---|---|---|---|---|---|---|---|---|---|---|---|
| Pixel Row address | Group | 1 | 2 | 3 | 4 | ... | n-2 | n-1 | n | 1 | 2 | 3 | 4 | ... | n-3 | n-2 | n-1 | n |
| 1/o(dd) | 1 | 1 | 0 | 0 | 0 | ... | 0 | 0 | 0 | 1 | 0 | 0 | 0 | ... | 0 | 0 | 0 | 0 |
| 1/e(ven) | 1 | 0 | 1 | 0 | 0 | ... | 0 | 0 | 0 | 1 | 0 | 0 | 0 | ... | 0 | 0 | 0 | 0 |
| 2/odd | 1 | 0 | 1 | 0 | 0 | ... | 0 | 0 | 0 | 0 | 1 | 0 | 0 | ... | 0 | 0 | 0 | 0 |
| 2/even | 1 | 0 | 0 | 1 | 0 | ... | 0 | 0 | 0 | 0 | 1 | 0 | 0 | ... | 0 | 0 | 0 | 0 |
| 3/odd | 1 | 0 | 0 | 1 | 0 | ... | 0 | 0 | 0 | 0 | 0 | 1 | 0 | ... | 0 | 0 | 0 | 0 |
| 3/even | 1 | 0 | 0 | 0 | 1 | ... | 0 | 0 | 0 | 0 | 0 | 1 | 0 | ... | 0 | 0 | 0 | 0 |
| 4/odd | 1 | 0 | 0 | 0 | 1 | ... | 0 | 0 | 0 | 0 | 0 | 0 | 1 | ... | 0 | 0 | 0 | 0 |
| ..... | ..... | | | | | ... | | | | | | | | ... | | | | |
| ..... | ..... | | | | | ... | | | | | | | | ... | | | | |
| n-2/odd | 1 | 0 | 0 | 0 | 0 | ... | 1 | 0 | 0 | 0 | 0 | 0 | 0 | ... | 0 | 1 | 0 | 0 |
| n-2/even | 1 | 0 | 0 | 0 | 0 | ... | 0 | 1 | 0 | 0 | 0 | 0 | 0 | ... | 0 | 1 | 0 | 0 |
| n-1/odd | 1 | 0 | 0 | 0 | 0 | ... | 0 | 1 | 0 | 0 | 0 | 0 | 0 | ... | 0 | 0 | 1 | 0 |
| n-1/even | 1 | 0 | 0 | 0 | 0 | ... | 0 | 0 | 1 | 0 | 0 | 0 | 0 | ... | 0 | 0 | 1 | 0 |
| n/odd | 1 | 0 | 0 | 0 | 0 | ... | 0 | 0 | 1 | 0 | 0 | 0 | 0 | ... | 0 | 0 | 0 | 1 |
| n/even | 1 | 1 | 0 | 0 | 0 | ... | 0 | 0 | 0 | 0 | 0 | 0 | 0 | ... | 0 | 0 | 0 | 1 |
| n+1/odd | 2 | 1 | 0 | 0 | 0 | ... | 0 | 0 | 0 | 0 | 1 | 0 | 0 | ... | 0 | 0 | 0 | 0 |
| n+1/even | 2 | 0 | 1 | 0 | 0 | ... | 0 | 0 | 0 | 0 | 1 | 0 | 0 | ... | 0 | 0 | 0 | 0 |
| n+2/odd | 2 | 0 | 1 | 0 | 0 | ... | 0 | 0 | 0 | 0 | 0 | 1 | 0 | ... | 0 | 0 | 0 | 0 |
| n+2/even | 2 | 0 | 0 | 1 | 0 | ... | 0 | 0 | 0 | 0 | 0 | 1 | 0 | ... | 0 | 0 | 0 | 0 |
| n+3/odd | 2 | 0 | 0 | 1 | 0 | ... | 0 | 0 | 0 | 0 | 0 | 0 | 1 | ... | 0 | 0 | 0 | 0 |
| n+3/even | 2 | 0 | 0 | 0 | 1 | ... | 0 | 0 | 0 | 0 | 0 | 0 | 1 | ... | 0 | 0 | 0 | 0 |
| n+4/odd | 2 | 0 | 0 | 0 | 1 | ... | 0 | 0 | 0 | 0 | 0 | 0 | 0 | ... | 0 | 0 | 0 | 0 |
| ..... | ..... | | | | | ... | | | | | | | | ... | | | | |
| ..... | ..... | | | | | ... | | | | | | | | ... | | | | |
| 2*n-2/odd | 2 | 0 | 0 | 0 | 0 | ... | 1 | 0 | 0 | 0 | 0 | 0 | 0 | ... | 0 | 0 | 1 | 0 |
| 2*n-2/even | 2 | 0 | 0 | 0 | 0 | ... | 0 | 1 | 0 | 0 | 0 | 0 | 0 | ... | 0 | 0 | 1 | 0 |
| 2*n-1/odd | 2 | 0 | 0 | 0 | 0 | ... | 0 | 1 | 0 | 0 | 0 | 0 | 0 | ... | 0 | 0 | 0 | 1 |
| 2*n-1/even | 2 | 0 | 0 | 0 | 0 | ... | 0 | 0 | 1 | 0 | 0 | 0 | 0 | ... | 0 | 0 | 0 | 1 |
| 2*n/odd | 2 | 0 | 0 | 0 | 0 | ... | 0 | 0 | 1 | 1 | 0 | 0 | 0 | ... | 0 | 0 | 0 | 0 |
| 2*n/even | 2 | 1 | 0 | 0 | 0 | ... | 0 | 0 | 0 | 1 | 0 | 0 | 0 | ... | 0 | 0 | 0 | 0 |
| 2*n+1/o | 3 | 1 | 0 | 0 | 0 | ... | 0 | 0 | 0 | 0 | 0 | 1 | 0 | ... | 0 | 0 | 0 | 0 |
| 2*n+1/e | 3 | 0 | 1 | 0 | 0 | ... | 0 | 0 | 0 | 0 | 0 | 1 | 0 | ... | 0 | 0 | 0 | 0 |
| 2*n+2/o | 3 | 0 | 1 | 0 | 0 | ... | 0 | 0 | 0 | 0 | 0 | 0 | 1 | ... | 0 | 0 | 0 | 0 |
| 2*n+2/e | 3 | 0 | 0 | 1 | 0 | ... | 0 | 0 | 0 | 0 | 0 | 0 | 1 | ... | 0 | 0 | 0 | 0 |
| 2*n+3/odd | 3 | 0 | 0 | 1 | 0 | ... | 0 | 0 | 0 | 0 | 0 | 0 | 0 | ... | 0 | 0 | 0 | 0 |
| 2*n+3/even | 3 | 0 | 0 | 0 | 1 | ... | 0 | 0 | 0 | 0 | 0 | 0 | 0 | ... | 0 | 0 | 0 | 0 |

FIG. 4B

| | | | | | | | | | | | | | | | | | | |
|---|---|---|---|---|---|---|---|---|---|---|---|---|---|---|---|---|---|---|
| 2*n+4/odd | 3 | 0 | 0 | 0 | 1 | ... | 0 | 0 | 0 | 0 | 0 | 0 | 0 | ... | 0 | 0 | 0 | 0 |
| ..... | ..... | | | | | ... | | | | | | | | ... | | | | |
| ..... | ..... | | | | | ... | | | | | | | | ... | | | | |
| 3*n−2/odd | 3 | 0 | 0 | 0 | 0 | ... | 1 | 0 | 0 | 0 | 0 | 0 | 0 | ... | 0 | 0 | 0 | 1 |
| 3*n−2/even | 3 | 0 | 0 | 0 | 0 | ... | 0 | 1 | 0 | 0 | 0 | 0 | 0 | ... | 0 | 0 | 0 | 1 |
| 3*n−1/odd | 3 | 0 | 0 | 0 | 0 | ... | 0 | 1 | 0 | 1 | 0 | 0 | 0 | ... | 0 | 0 | 0 | 0 |
| 3*n−1/even | 3 | 0 | 0 | 0 | 0 | ... | 0 | 0 | 1 | 1 | 0 | 0 | 0 | ... | 0 | 0 | 0 | 0 |
| 3*n/odd | 3 | 0 | 0 | 0 | 0 | ... | 0 | 0 | 1 | 0 | 1 | 0 | 0 | ... | 0 | 0 | 0 | 0 |
| 3*n/even | 3 | 1 | 0 | 0 | 0 | ... | 0 | 0 | 0 | 0 | 1 | 0 | 0 | ... | 0 | 0 | 0 | 0 |
| ..... | ..... | | | | | ... | | | | | | | | ... | | | | |
| ..... | ..... | | | | | ... | | | | | | | | ... | | | | |
| ..... | ..... | | | | | ... | | | | | | | | ... | | | | |
| ..... | ..... | | | | | ... | | | | | | | | ... | | | | |
| (m−2)n+1/o | m−1 | 1 | 0 | 0 | 0 | ... | 0 | 0 | 0 | 0 | 0 | 0 | 0 | ... | 0 | 0 | 1 | 0 |
| (m−2)*n+1/e | m−1 | 0 | 1 | 0 | 0 | ... | 0 | 0 | 0 | 0 | 0 | 0 | 0 | ... | 0 | 0 | 1 | 0 |
| (m−2)*n+2/o | m−1 | 0 | 1 | 0 | 0 | ... | 0 | 0 | 0 | 0 | 0 | 0 | 0 | ... | 0 | 0 | 0 | 1 |
| (m−2)*n+2/e | m−1 | 0 | 0 | 1 | 0 | ... | 0 | 0 | 0 | 0 | 0 | 0 | 0 | ... | 0 | 0 | 0 | 1 |
| (m−2)*n+3/o | m−1 | 0 | 0 | 1 | 0 | ... | 0 | 0 | 0 | 1 | 0 | 0 | 0 | ... | 0 | 0 | 0 | 0 |
| (m−2)*n+3/e | m−1 | 0 | 0 | 0 | 1 | ... | 0 | 0 | 0 | 1 | 0 | 0 | 0 | ... | 0 | 0 | 0 | 0 |
| (m−2)*n+4/o | m−1 | 0 | 0 | 0 | 1 | ... | 0 | 0 | 0 | 0 | 1 | 0 | 0 | ... | 0 | 0 | 0 | 0 |
| ..... | ..... | | | | | ... | | | | | | | | ... | | | | |
| ..... | ..... | | | | | ... | | | | | | | | ... | | | | |
| (m−1)*n−2/o | m−1 | 0 | 0 | 0 | 0 | ... | 1 | 0 | 0 | 0 | 0 | 0 | 0 | ... | 0 | 0 | 0 | 0 |
| (m−1)*n−2/e | m−1 | 0 | 0 | 0 | 0 | ... | 0 | 1 | 0 | 0 | 0 | 0 | 0 | ... | 0 | 0 | 0 | 0 |
| (m−1)*n−1/o | m−1 | 0 | 0 | 0 | 0 | ... | 0 | 1 | 0 | 0 | 0 | 0 | 0 | ... | 1 | 0 | 0 | 0 |
| (m−1)*n−1/e | m−1 | 0 | 0 | 0 | 0 | ... | 0 | 0 | 1 | 0 | 0 | 0 | 0 | ... | 1 | 0 | 0 | 0 |
| (m−1)*n/o | m−1 | 0 | 0 | 0 | 0 | ... | 0 | 0 | 1 | 0 | 0 | 0 | 0 | ... | 0 | 1 | 0 | 0 |
| (m−1)*n/e | m−1 | 1 | 0 | 0 | 0 | ... | 0 | 0 | 0 | 0 | 0 | 0 | 0 | ... | 0 | 1 | 0 | 0 |
| (m−1)n+1/o | m | 1 | 0 | 0 | 0 | ... | 0 | 0 | 0 | 0 | 0 | 0 | 0 | ... | 0 | 0 | 0 | 1 |
| (m−1)*n+1/e | m | 0 | 1 | 0 | 0 | ... | 0 | 0 | 0 | 0 | 0 | 0 | 0 | ... | 0 | 0 | 0 | 1 |
| (m−1)*n+2/o | m | 0 | 1 | 0 | 0 | ... | 0 | 0 | 0 | 1 | 0 | 0 | 0 | ... | 0 | 0 | 0 | 0 |
| (m−1)*n+2/e | m | 0 | 0 | 1 | 0 | ... | 0 | 0 | 0 | 1 | 0 | 0 | 0 | ... | 0 | 0 | 0 | 0 |
| (m−1)*n+3/o | m | 0 | 0 | 1 | 0 | ... | 0 | 0 | 0 | 0 | 1 | 0 | 0 | ... | 0 | 0 | 0 | 0 |
| (m−1)*n+3/e | m | 0 | 0 | 0 | 1 | ... | 0 | 0 | 0 | 0 | 1 | 0 | 0 | ... | 0 | 0 | 0 | 0 |
| (m−1)*n+4/o | m | 0 | 0 | 0 | 1 | ... | 0 | 0 | 0 | 0 | 0 | 1 | 0 | ... | 0 | 0 | 0 | 0 |
| ..... | ..... | | | | | ... | | | | | | | | ... | | | | |
| ..... | ..... | | | | | ... | | | | | | | | ... | | | | |
| m*n−2/o | m | 0 | 0 | 0 | 0 | ... | 1 | 0 | 0 | 0 | 0 | 0 | 0 | ... | 1 | 0 | 0 | 0 |
| m*n−2/e | m | 0 | 0 | 0 | 0 | ... | 0 | 1 | 0 | 0 | 0 | 0 | 0 | ... | 1 | 0 | 0 | 0 |
| m*n−1/o | m | 0 | 0 | 0 | 0 | ... | 0 | 1 | 0 | 0 | 0 | 0 | 0 | ... | 0 | 1 | 0 | 0 |
| m*n−1/e | m | 0 | 0 | 0 | 0 | ... | 0 | 0 | 1 | 0 | 0 | 0 | 0 | ... | 0 | 1 | 0 | 0 |
| m*n/o | m | 0 | 0 | 0 | 0 | ... | 0 | 0 | 1 | 0 | 0 | 0 | 0 | ... | 0 | 0 | 1 | 0 |
| m*n/e | m | 1 | 0 | 0 | 0 | ... | 0 | 0 | 0 | 0 | 0 | 0 | 0 | ... | 0 | 0 | 1 | 0 |

DRIVING METHOD AND CIRCUIT FOR PIXEL MULTIPLEXING CIRCUITS

BACKGROUND OF THE INVENTION

1. Field of the Invention

The present invention relates to pixel display circuits and, more particularly, to a method for driving these circuits to provide integrated data and gate multiplexing.

2. Description of the Related Art

Due to poor charging ability in amorphous silicon thin film transistors (a-Si TFTs) resulting from inherently low TFT transconductance, all commercially available a-Si TFT liquid crystal displays (LCD) include an array of pixel elements connected with row and column metal lines. The row and column drivers require higher transconductance devices. The row and column drivers typically include crystalline silicon technology and are separately fabricated and attached to the a-Si TFT LCDs. Over the years, there have been attempts at integrating some level of multiplexing between the attached crystalline silicon drivers and the pixel array. See for example, U.S. Pat. No. 5,175,446 to R. Stewart. In this way, the number of crystalline drivers needed could be reduced. These prior art designs follow a circuit approach that is commonly used in crystalline silicon circuit designs. Even simple 2:1 level multiplexing schemes at the edge of a pixel array have not been implemented for a-Si TFT LCD circuits. Although not realized for direct view a-Si TFT LCDs, multiplexer circuits have been implemented with some success in smaller displays for example, in light valves and in poly-silicon technology. Poly-silicon TFTs make it possible to realize a higher transconductance TFT. However, implementing poly-silicon technology on larger and/or high resolution TFT LCDs becomes unacceptable due to higher RC load and/or higher bandwidth rates of the rows and columns.

Therefore, a need exists for a control circuit for providing integrated data and gate multiplexing for active matrix LCDs without impacting acceptable display limits. A further need exists for a method of driving these displays which compensates for feedthrough voltage, an effective value and gate waveform delay.

SUMMARY OF THE INVENTION

A driving method for multiplexing pixels in active matrix displays in accordance with the present invention includes the steps of providing a plurality of pixels arranged in an array, wherein each pixel includes at least two transistors associated therewith, the transistors disposed in the array of pixels and each pixel including a plurality of control lines for controlling the transistors for turning each pixel on and off and sequencing waveforms on the control lines to provide multiplexing at the pixels in the array.

In alternate methods, the control lines include enable and row lines and a step of sequencing waveforms may further include the step of adjusting timing sequences of the waveforms wherein at least one pair of an adjacent enable line and row line are activated simultaneously to create a conducting path, through the at least two transistors, between a data line and a storage node. The step of activating the control lines by employing a gate driver may be included. The gate driver may include a plurality of outputs and the step of connecting the outputs of the gate driver in parallel with a plurality of control lines may also be included. The control lines may include row lines connected to gates of one of the at least two transistors and enable lines connected to gates of another transistor of the at least two transistors, the row lines and enable lines being alternately disposed within the array of pixels and the method may further include the step of providing waveforms on the enable lines having a fall time after a fall time of an adjacent row line wherein a difference in fall times ensures proper discharge and turn off of the gates of the transistors.

The driving method may include row lines and may further include the steps of providing storage capacitors having a charging electrode and a counter electrode, the charging electrode coupled to one of the at least two transistors for each pixel and the counter electrode including a first row line and compensating for feedthrough voltage on the storage capacitor by providing a negative (positive) pulse on the first row line while charging the charging electrode with a positive (negative) pulse on a second row line. The driving method may include row lines and further include the steps of providing storage capacitors having a charging electrode and a counter electrode, the charging electrode coupled to one of the at least two transistors for each pixel and the counter electrode including a first row line and compensating for an effective value of a data line voltage by providing a negative (positive) pulse on the first row line while charging the charging electrode with a positive (negative) pulse on a second row line. The step of adjusting signal delay on controls lines between pixels may also be included. The step of sequencing waveforms may include the step of addressing half of the pixels in a first time subframe and a second half of the pixels in a second time subframe. The array preferably includes columns of pixels and the method may further include the step of addressing the pixels in a first set of alternating column pairs of pixels in a first set of time slots and addressing a second set of alternating column pairs of pixels in a second set of time slots such that all pixels in the array are addressed in the first and second sets of time slots. The array preferably includes rows of pixels and the method may further include the step of addressing the pixels in the alternating column pairs for each pair of rows of pixels. The array preferably includes columns of pixels and the method may further include the step of addressing the pixels in a first set of alternating column pairs of pixels in a first time subframe and addressing a second set of alternating column pairs of pixels in a next consecutive time subframe such that all pixels in the array are addressed in the first and next consecutive time subframes. The pixels may be grouped in dot pairs and the method may further include the step of addressing the pixels in a first half of dot pairs of pixels in a first time subframe and addressing a second half of dot pairs of pixels in a next consecutive time subframe such that all pixels in the array are addressed in the first and next consecutive time subframes.

A circuit for addressing pixels in a pixel array in accordance with the present invention includes at least two transistors associated with each pixel, the transistors disposed in the array of pixels. A plurality of control lines associated with each pixel for controlling the transistors of each pixel. At least one gate driver sequences waveforms on the control lines to provide multiplexing at the pixels in the array.

In alternate embodiments of the circuit, the control lines may include enable and row lines such that at least one pair of an adjacent enable line and row line are activated simultaneously to create a conducting path through the at least two transistors between a data line and a storage capacitor. The gate driver may include a semiconductor chip. The gate driver preferably includes a plurality of outputs, and the outputs of the gate driver may be connected in parallel with a plurality of control lines. The control lines may include row lines connected to gates of one of the at least two transistors and enable lines connected to gates of another transistor of the at least two transistors, the row lines and enable lines being alternately disposed within the array of pixels and shared between adjacent rows of pixels. The at least two transistors preferably include thin film transistors. The circuit may include two gate drivers. The at least one gate driver may have outputs split into a first group and a second group such that a duty cycle and a capacitive load for the outputs is reduced by one half. The circuit for addressing pixels may include an integrated circuit.

These and other objects, features and advantages of the present invention will become apparent from the following detailed description of illustrative embodiments thereof, which is to be read in connection with the accompanying drawings.

BRIEF DESCRIPTION OF DRAWINGS

The invention will be described in detail in the following description of preferred embodiments with reference to the following figures wherein:

FIG. 4 is an illustrative output listing for gate drivers in accordance with the present invention;

DETAILED DESCRIPTION OF PREFERRED EMBODIMENTS

The present invention relates to pixel display circuits and, more particularly, to a method for driving these circuits to provide integrated data and gate multiplexing in the pixels within the array. The present invention provides a novel design for driving gate and data line drivers for implementing the multiplexing functions from circuitry implemented within the pixel rather than from circuitry at the data or gate line ends. The present invention does not follow the prior art schemes of implementing crystalline silicon multiplexer designs with amorphous silicon thin film transistors (TFTs), nor does the present invention follow the prior art scheme of placing the multiplexers between the pixel array and the externally attached crystalline silicon drivers.

The present invention provides an RC load that is reduced to about a load within a pixel. This may be implemented by employing a TFT gate of minimum length and width as described hereinbelow. Whereas the prior art needed to drive a full load of the gate or data line to accomplish gate or data multiplexing.

The method of the present invention provides a driving scheme that compensates for feedthrough voltage, an effective value and gate waveform delay for TFTs used within the circuitry.

Figure 1:
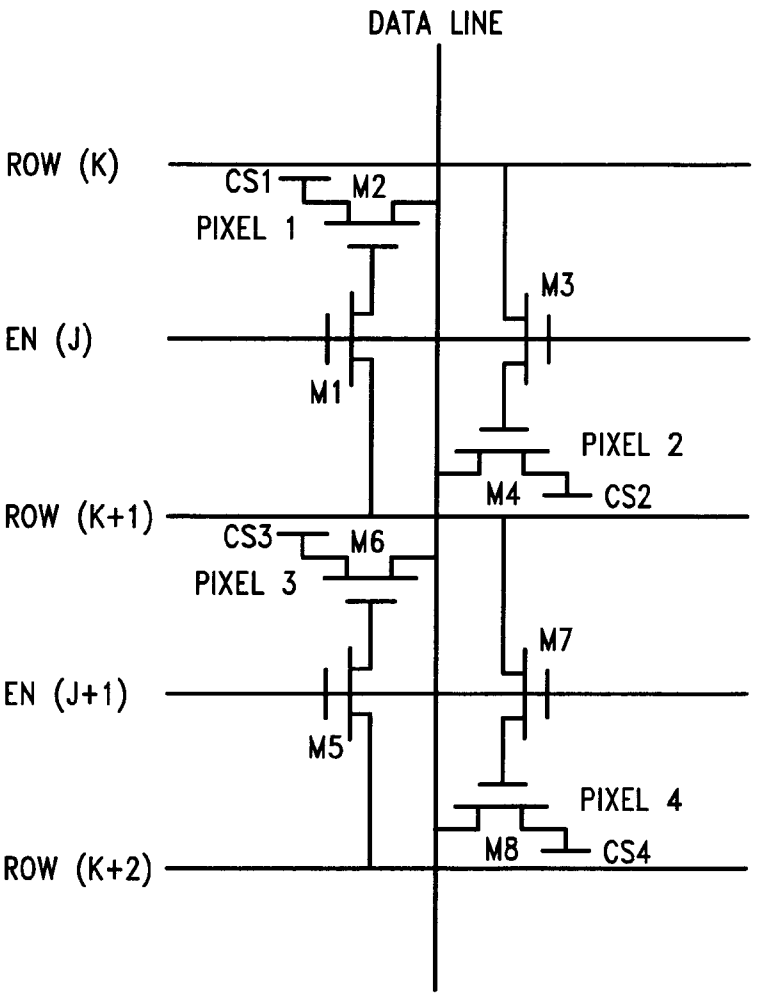
FIG. 1 is a schematic diagram of a pixel circuit showing two TFTs per pixel in accordance with the present invention.

Referring now in detail to the figures in which like numerals represent the same or similar elements and initially to FIG. 1, a schematic diagram of four pixels (1 through 4) and driving circuitry in accordance with the present invention is shown. Scan lines (shown as ROW and EN lines in FIG. 1) are reduced to three per pixel. ROW(K) is shared with a previous row of pixels while ROW(K+1) is shared with a next row of pixels. The sharing of scan lines increases aperture area for pixels in the array. Enabling transistors, for example, thin film transistors (TFTs) include M1, M3, M5 and M7. Data line transfer transistors include M2, M4, M6 and M8. When enabling transistors are activated by enable signals EN, they conduct and thereby activate data line transfer transistors. Data line transfer transistors provide a conductive path between DATA LINE and storage capacitors (CS1, CS2, CS3 and/or CS4).

Figure 2:
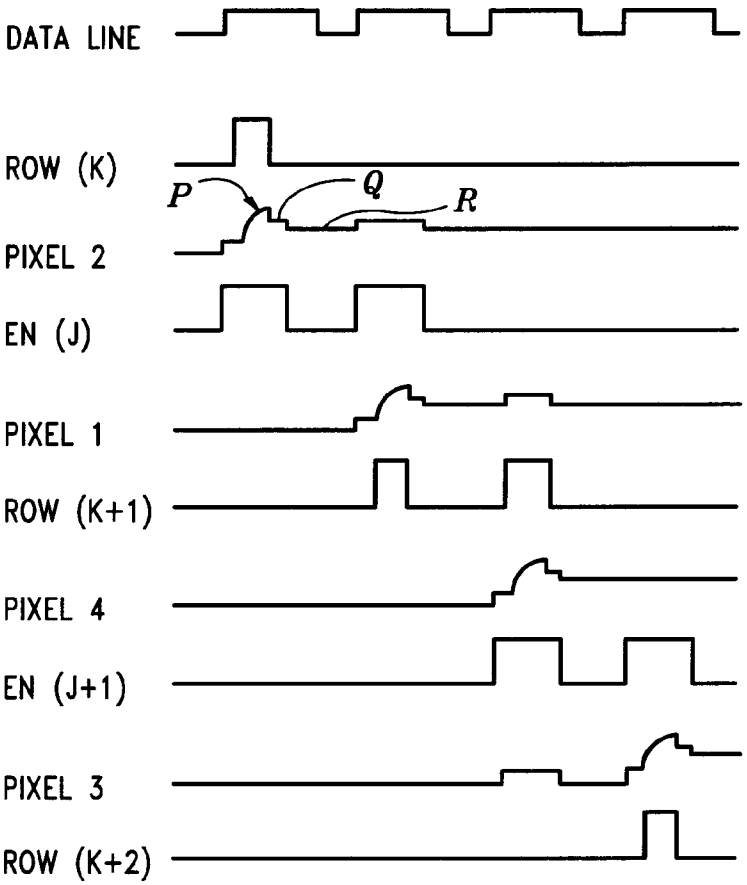
FIG. 2 is a timing diagram for the circuit of FIG. 1 in accordance with the present invention showing minimum timing requirements.

Turning now to FIG. 2, a timing diagram for the circuit of FIG. 1, with continued reference to FIG. 1, an illustrative mode of operation is shown. The mode of operation includes an EN(J) pulse high width which overlaps ROW(K)and ROW(K+1) pulses. Likewise, in a similar fashion, EN(J+1) pulse high width overlaps ROW(K+1) and ROW(K+2) pulse. This ensures that a gate node on M2 and M4, or M6 and M8 are discharged via M1 and M3, and M5 and M7, respectively, and will not act as a charge storage node that prevents M4 and M2, or M8 and M6 from turning off. Further, only two adjacent scan lines are needed to turn any pixel on. In this example, a shared common DATA LINE between pixels provides a 2:1 data demultiplexing function, and ROW and EN lines provide an m:1 gate demultiplexing function, where m is an integer larger than 1. EN(J) and EN(J+1) pulse widths may be larger than ROW(K), ROW (K+1) and ROW(K+2) pulse widths. This implementation can provide line pulse width flexibility and, in general, line pulse widths and relative positions may be different between EN lines and row lines. For example, when EN(J) is high, enable TFTs M1 and M3 are turned on. ROW(K) and (ROW(K+1)) voltage is placed on the gates of TFTs M4 and M2, respectively. If ROW(K) (ROW(K+1)) is high, TFT M4 (M2) conducts and transfers the DATA LINE voltage to CS2 (CS1). If ROW(K) (ROW(K+1)) is low, TFT M4 (M2) does not conduct, and the data line voltage is not transferred to CS2(CS1) and leaves a prior charge placed on CS2 (CS1). Although not shown, a liquid crystal voltage exists across a first node at a source of TFT M2 (M4) where CS1 (CS2) is connected, and a second node to a common plate ITO (indium tin oxide)voltage (not shown).

Figure 3:
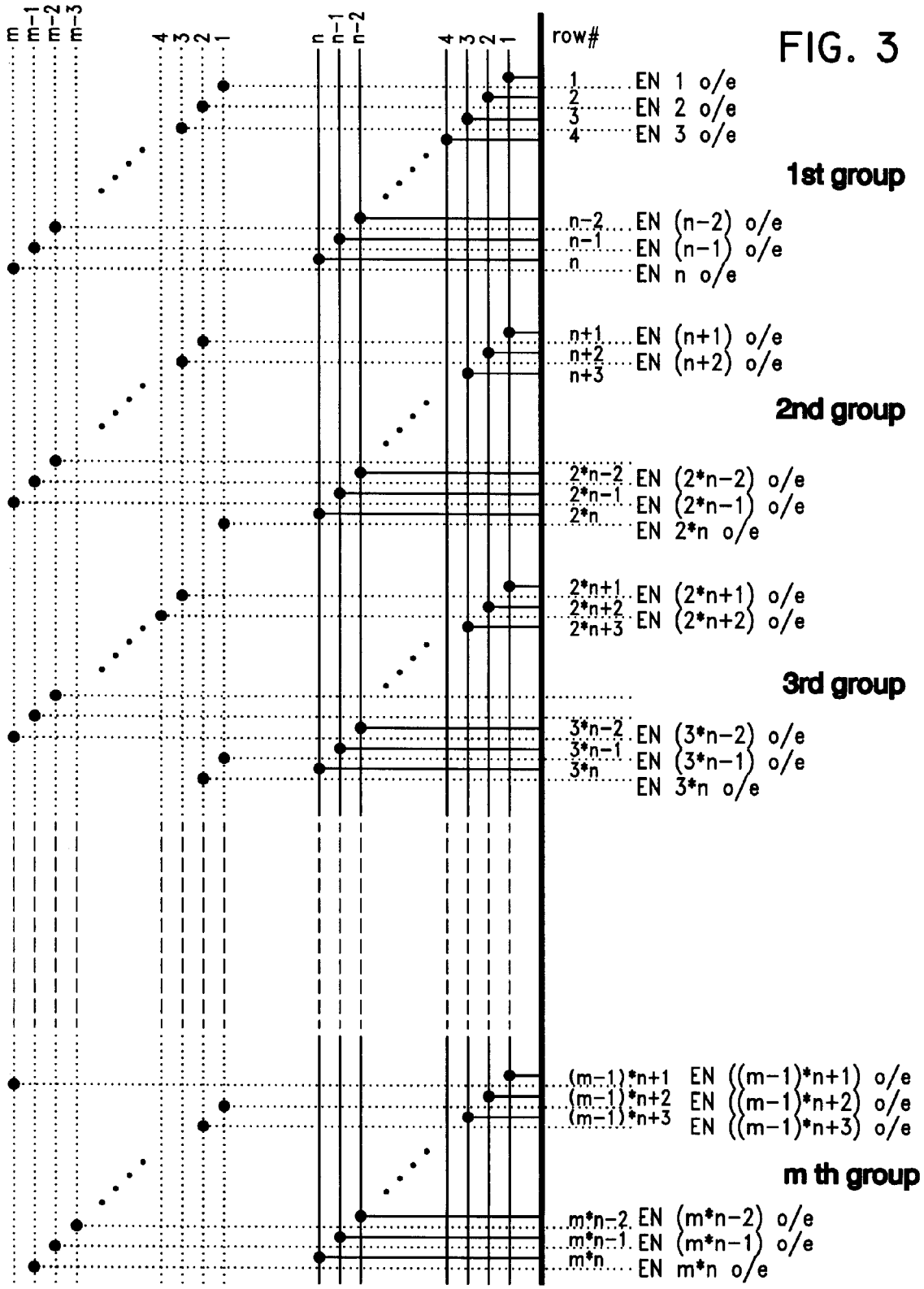
FIG. 3 is a schematic diagram showing a fanout wiring for a demultiplexer in an active matrix array in accordance with the present invention.

Referring to FIG. 3, an illustrative example of row fan-out wiring for gate demultiplexing is shown. An m:1 gate multiplexing function is provided. Signal line labeled "EN1 o/e" through EN m*n o/e" represent pulses to the gates of the enable TFTs M1, M3, M5 and M7. The odd (M2 and M6) and even (M4 and M8) pixel access (data line transfer) TFTs are designated by the nomenclature "o" and "e". Also, "row #" 1 through m*n represent scan lines to which the storage capacitors (i.e., CS1 and CS2) overlap onto. In one example, if m=n, and XGA and SXGA color displays are used, gate driver outputs may be multiplexed to approximately 28:1 and 32:1, respectively.

The above figures have shown gate driver outputs being multiplexed 2:1, however, higher data line multiplexing is possible through the introduction of additional scan lines. A circuit is provided in accordance with the present invention which incorporates m:1 gate demultiplexing and L:1 data demultiplexing, where m and L are integers greater than 1.

Referring to FIG. 4, an illustrative listing of pixel row address versus gate driver chip(s)outputs for ROWS and EN(ables) is shown corresponding to the fanout wiring shown in FIG. 3. A group, as indicated in FIG. 3, represents a one-to-one pairing of gate driver chip outputs to ROW lines. The number of groups equals a multiplexing ratio achieved, for example, m:1 for m groups. The number of lines in an addressing scheme may include man an optimum being at m=n to evenly stress each pixel. In preferred embodiments, n=m=28 for XGA displays and n=m=32 for SXGA displays.

Figure 5:
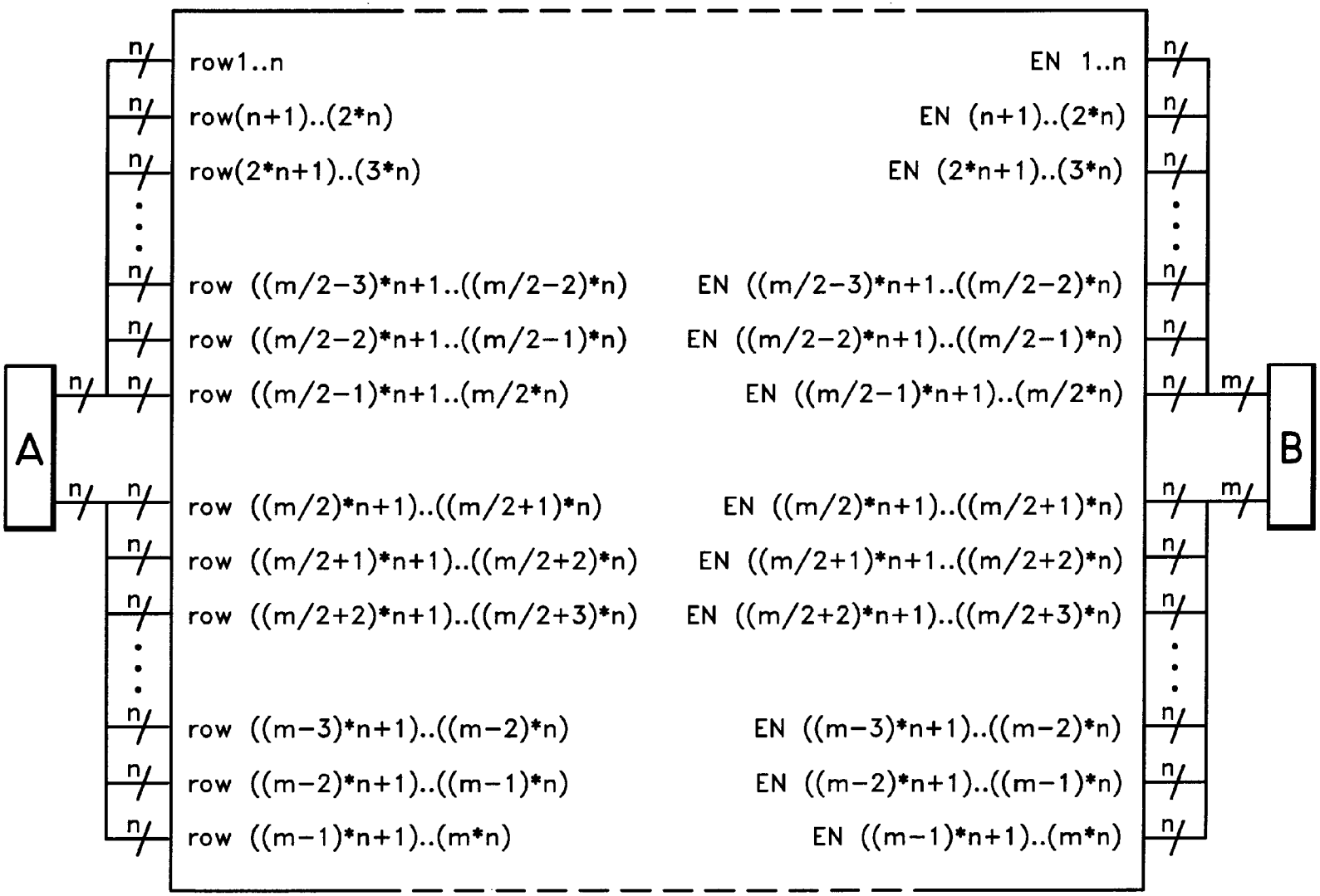
FIG. 5 is a schematic diagram of an addressing circuit for pixel multiplexing in accordance with the present invention.

Referring to FIG. 5, an illustrative addressing implementation is shown in accordance with the present invention. Two gate driver chips A and B are shown. Gate driver chip A provide signals to gates of TFTs connected to ROW lines. Gate driver chip B provides signals to gates of TFTs connected to EN lines. In the example addressing scheme for an active matrix display shown in FIG. 5, if enough driver outputs are available on each side, splitting of the output signal may be implemented. This results in a separate supply signal to the top half and the bottom half of the display. Advantageously, a half duty cycle and half capacitive load is realized for each output. This reduces power consumption for the display.

Figure 6:
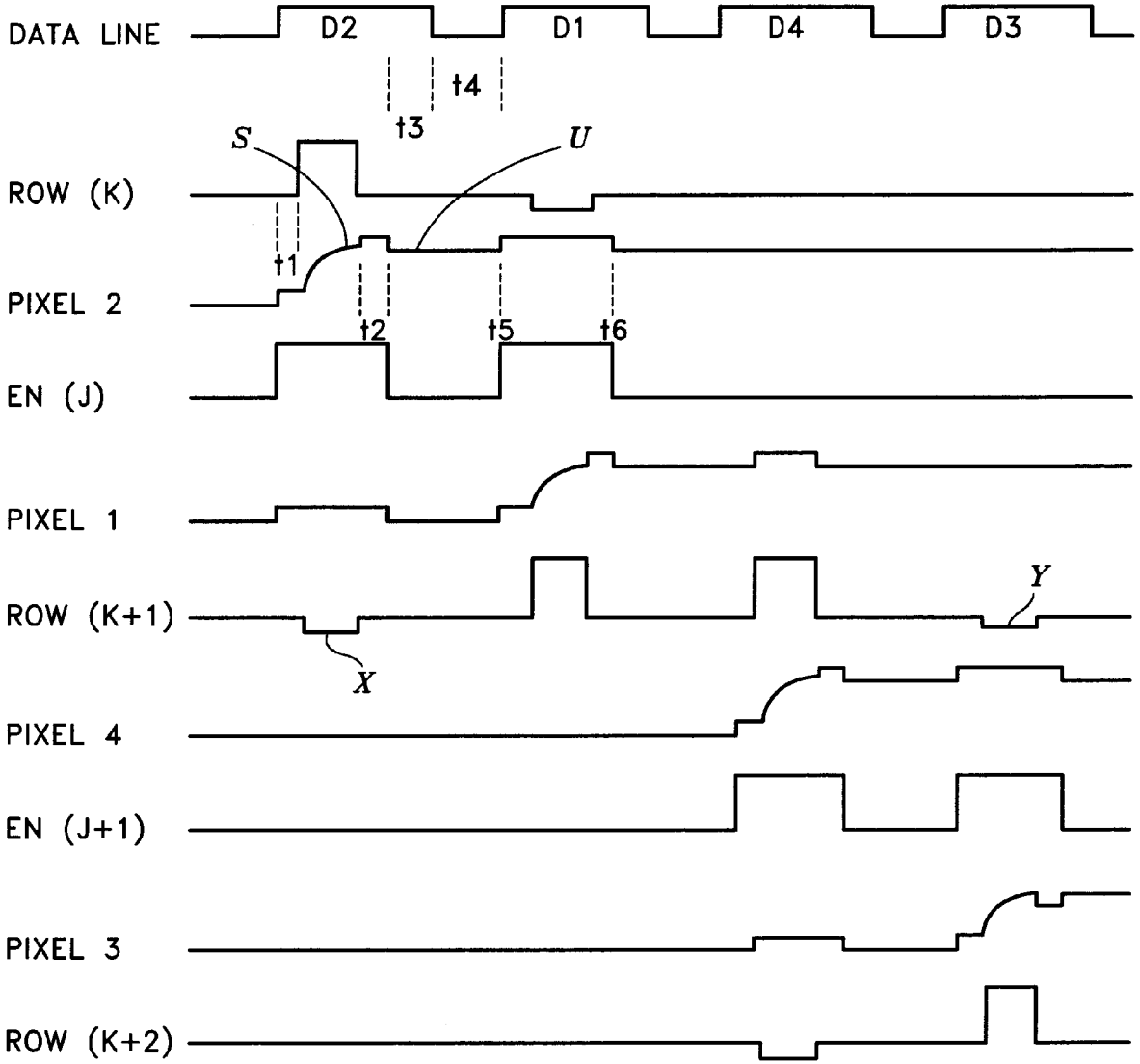
FIG. 6 is a timing diagram for the circuit of FIG. 1 having feedthrough voltage compensation, effective value compensation and delay compensation in accordance with the present invention.

Referring to FIG. 6, an improved timing diagram is shown for a driving method in accordance with the present invention. The timing diagram of FIG. 2 represents a minimum pulsing driving scheme, however, the scheme shown in FIG. 6 provides added compensation for feedthrough voltage, an effective value and gate waveform delay. As shown in FIG. 6, when data D2 is valid (logic high), EN(J) and ROW(K) are brought high. The time difference t1 may be positive (EN(J) going high before ROW(K)), negative (EN(J) going high after ROW(K)) or zero (EN(J) going high at the same time as ROW(K)). FIG. 6 shows the case where t1 is positive where EN(J) capacitively couples to PIXEL 2 at the start of t1. At the end of t1, ROW(K) goes high and the data line voltage D2 is applied to the liquid crystal and charges PIXEL 2. When ROW(K) goes low, TFT M4 (FIG. 1) is turned off, and the charged voltage to the liquid crystal D2 is reduced by a feedthrough voltage which is a fraction of the TFT channel charge left at turnoff and the TFT gate-to-drain parasitic overlap capacitance. A feedthrough voltage compensation is implemented by increasing the voltage level of a counter electrode (or ROW(K+1)) of storage capacitor CS2 (as indicated by X in FIG. 6) to a negative potential at the same timing as the rise and fall of the gate pulse ROW(K). The negative pulse on ROW(K+1) (as indicated by X in FIG. 6) has the effect of raising PIXEL 2 voltage to counteract any decrease from feedthrough within CS2. The feedthrough voltage is the capacitive coupling of a voltage without feedthrough voltage compensation, pixel voltage will see feedthrough voltage from ROW(K) off going transition P–Q. and from EN(J) off going transition of Q–R as indicated in FIG. 2. Feedthrough voltage compensation attempts to minimize the voltage difference S–U as indicated in FIG. 6.

A lower effective value (voltage needed to charge the storage capacitors) on DATA LINE may also be achieved in accordance with the invention by increasing a negative pulse amplitude of ROW(K+1) (the pulse indicated by Y in FIG. 6) by an additional amount according to a voltage divider ratio that exists between storage capacitor CS2, to a sum of the capacitances on the source node of M4 (e.g., storage capacitor CS2, liquid crystal capacitance and gate-to-drain parasitic capacitance). The resulting lower effective data voltage value on DATA LINE will result in lower power consumption. Similar pulses may be used for the other display pixels as well.

A gate waveform delay may exist between pixels. The gate waveform is the intended voltage pulses as a function of time on the gate line. The gate waveform delay between a first pixel and a last pixel on ROW(K) is accounted for by having a time difference t2 larger than a ROW(K) metal line pulse delay. t2 is the time difference between ROW(K) or ROW(K+1) going low and one of the pulses on EN(J) going low. The time difference t3 is positive and is defined as the time difference between EN(J) going low and D2 going low. t4 is the time between valid data D2 and D1, and may be positive or zero. At time t5 and t6 a positive and negative voltage coupling, respectively, is seen on PIXEL 2 from pulse on EN(J). The net coupling is equal but opposite so that a voltage error on PIXEL 2 is minimum when integrated over one time frame (that is the area under a curve between the time limits is minimum). In a similar driving scheme, PIXEL 1, PIXEL 4 and PIXEL 3 are charged to data voltage D1, D4 and D3, respectively. This driving method is consistent with several pulse variations. These may include but are not limited to the following: (1) The ROW and EN pulses may be the same pulse width as long as t2 is always positive, and in this way, a same gate driver can be used for ROW and EN pulses, and (2) the two line pulses on EN lines may be combined into a continuous pulse, and in this way, the line pulses on EN lines are one-half the bandwidth of the ROW lines.

The following description describes several driving methods which illustrate the present invention by way of example. Referring to FIGS. 7–14, other driving methods are described in accordance with the present invention. FIGS. 7, 9, 11 and 13 are pixel addressing maps, which are, for simplicity, limited in size and, FIGS. 8, 10, 12 and 14 are respective timing diagrams. In FIGS. 7–14, gate lines or row lines are labeled by G(n–1), G(n), G(n+1), etc., and enable lines are labeled by EN(n), EN(n+1), EN(n+2), etc. In the addressing maps, gate lines are represented by thin horizontal lines which transcribe the center of the pixel, and enable lines are represented by thick horizontal lines. Datalines are represented by thick vertical lines. Each space in the addressing map is a pixel which is controlled by two transistors associated with each pixel. The transistors are activated by adjacent control lines, i.e., gate lines and enable lines, and data is transferred on data lines. The columns of the array are numbered at the top and correspond to the vertical data lines. The pixels are marked with an S and a number representing a time slice in which the pixel is activated, for example S1, S2, etc. In FIGS. 7–10, two subframes are used to activate the pixels. Time slots in the first subframe are represented as S1, S2, S3, etc. while time slots for the second time frame are represented with a ', for example S1', S2', S3', etc. Each time frame (first and second may be flagged with FLAG=0 (even) or FLAG=1 (odd) as appropriate.

Figure 7:
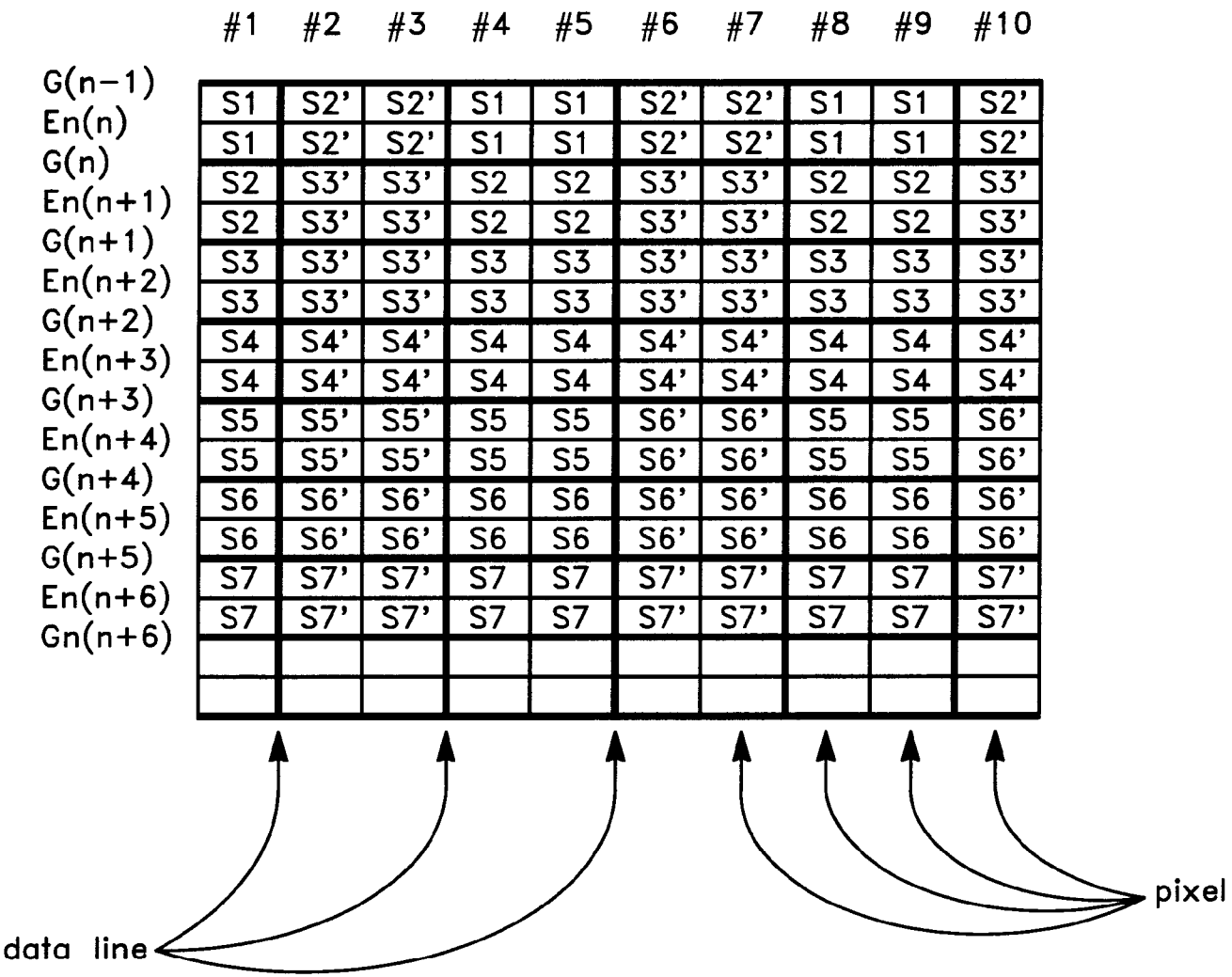
FIG. 7 is a pixel address map showing subpixels addressed in alternating column pairs based on consecutive time subframes in accordance with the present invention.
Figure 8:
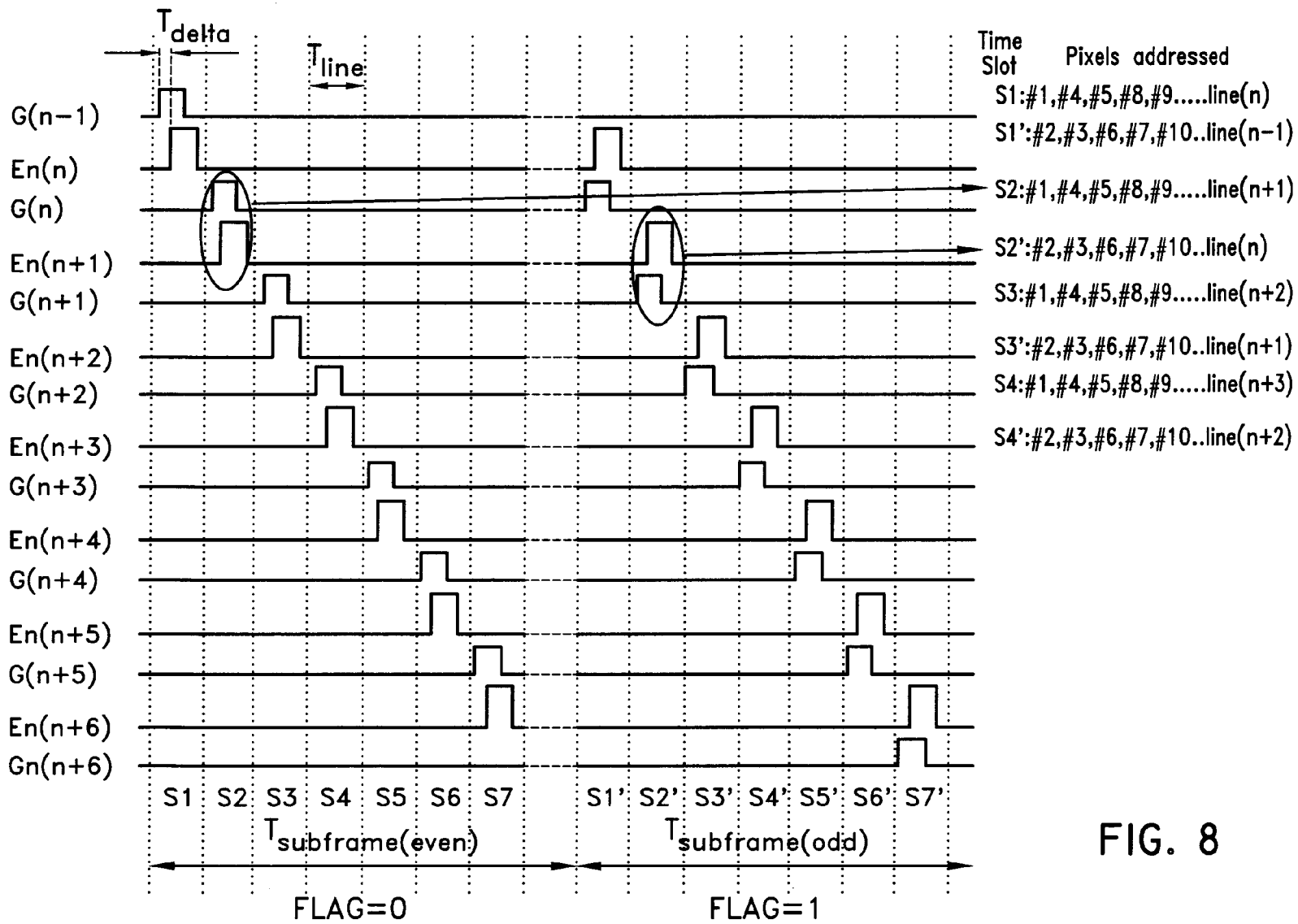
FIG. 8 is a timing diagram for the pixel addressing map of FIG. 7 in accordance with the present invention.

Referring now in more detail to each driving method and initially to FIGS. 7 and 8, one driving method addresses half of the pixels in a first set of alternate column pairs of pixels during the first subframe, and the second half of the pixels in a second set of alternate column pairs as indicated. This is preferably performed by using a driving scheme that sequentially addresses all gate rows (G) with a single pulse every subframe and with either an adjacent odd enable line for one subframe, or an adjacent even enable line for the other subframe, with a single pulse appearing on the enable line as shown in the circled portions of FIG. 8.

Figure 9:
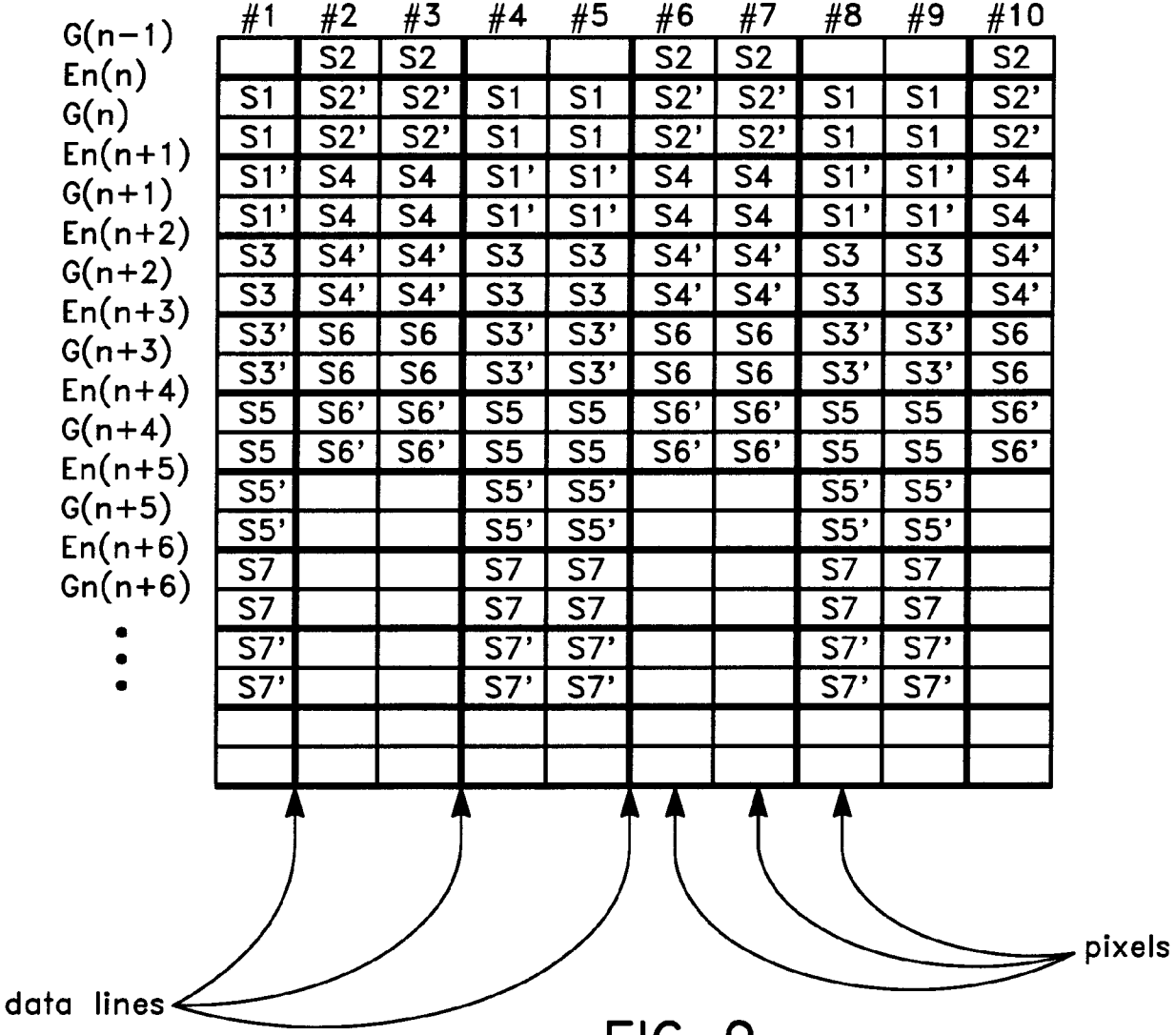
FIG. 9 is a pixel address map showing subpixels addressed in dot pairs based on consecutive time subframes in accordance with the present invention.
Figure 10:
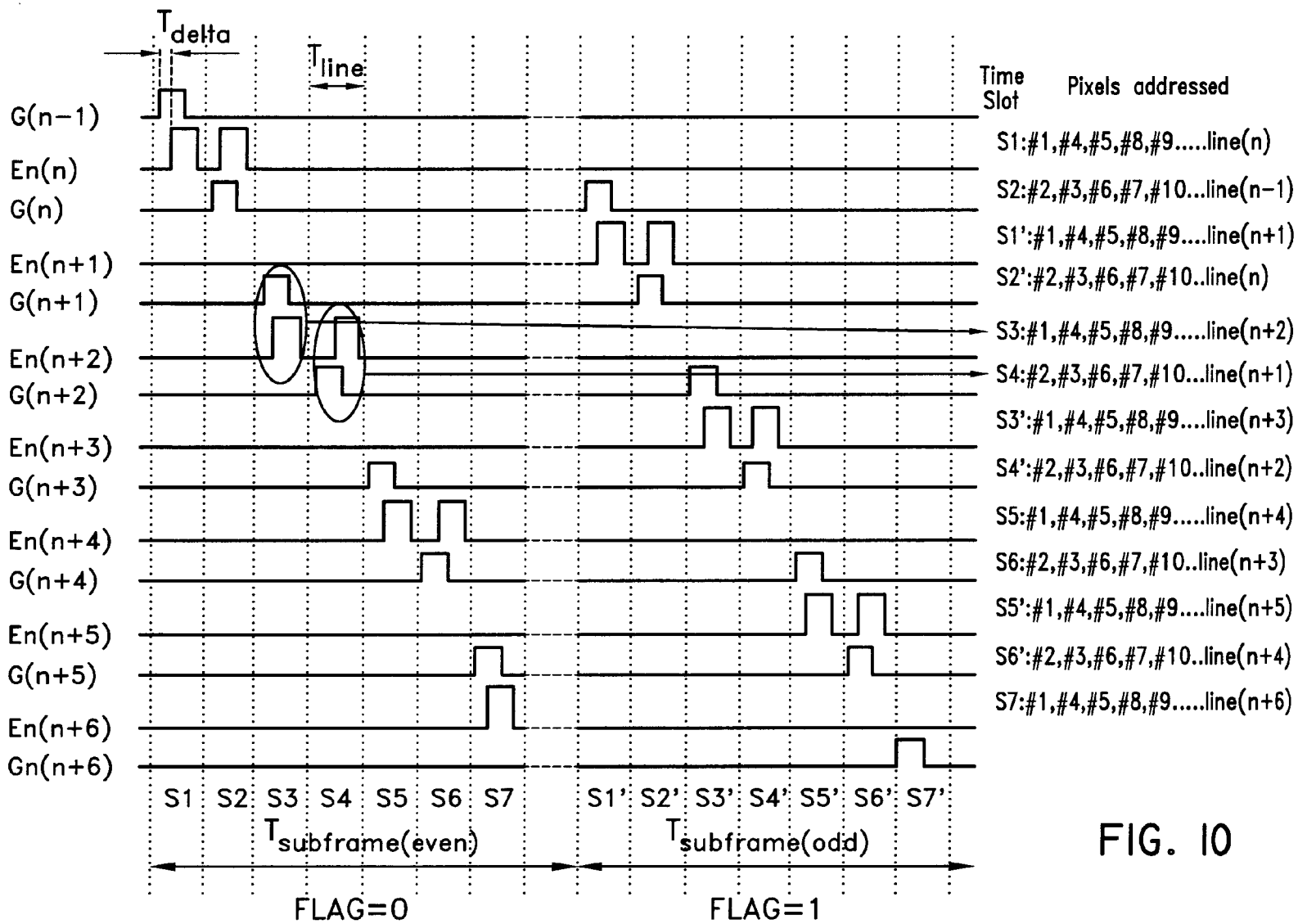
FIG. 10 is a timing diagram for the pixel addressing map of FIG. 9 in accordance with the present invention.

Referring to FIGS. 9 and 10, another driving method addresses half of the pixels in a first dot pair (i.e., dots being arranged in a "checkerboard" pattern) in the first subframe, and the second half of the pixels in a second dot pair as indicated. This is preferably performed by using a driving scheme that sequentially addresses all gate rows (G) with a single pulse every subframe and with either a following enable line for one subframe, or a prior enable line for the other subframe, with two consecutive pulses appearing on the enable line as shown in the circled portions of FIG. 10.

Figure 11:
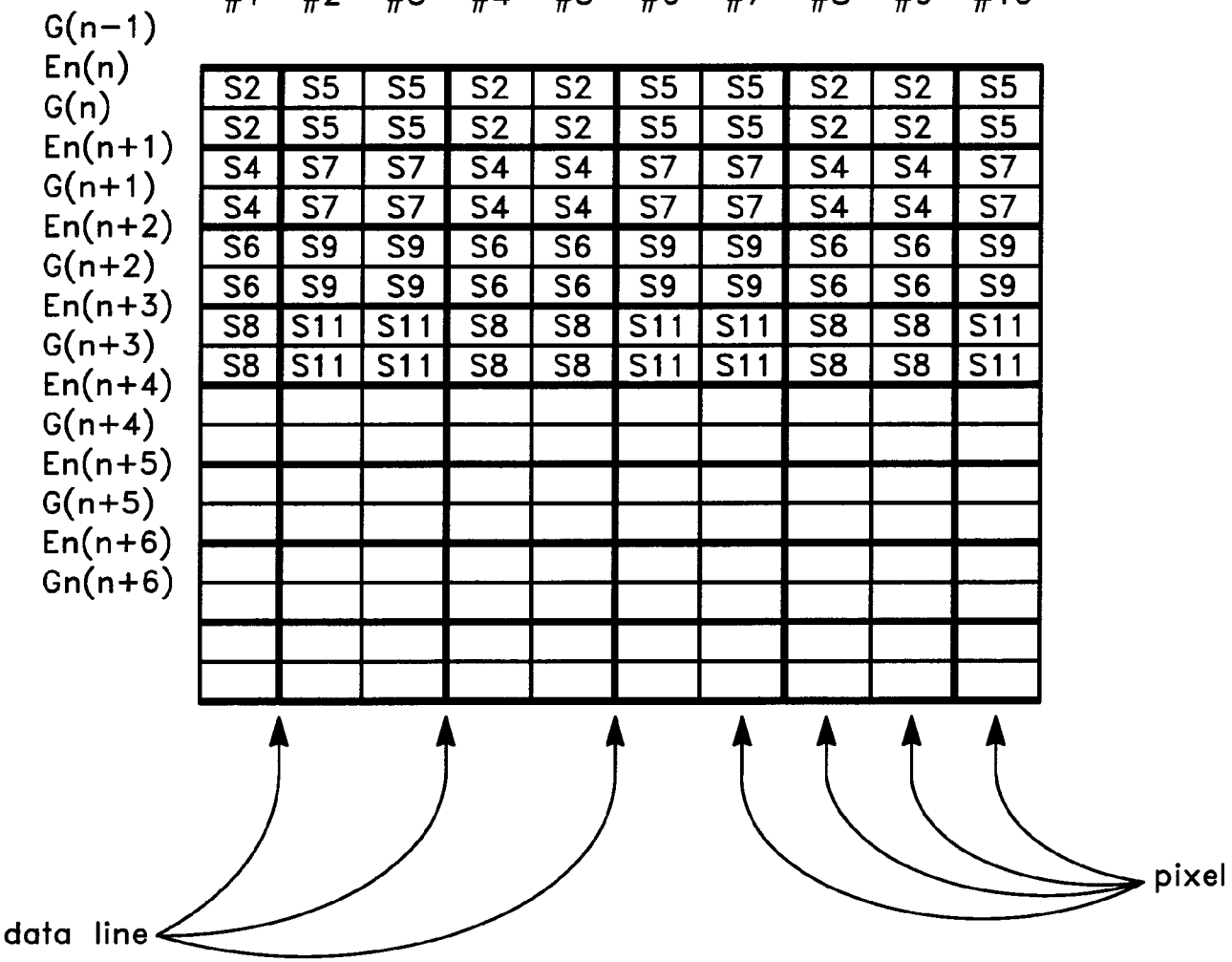
FIG. 11 is a pixel address map showing subpixels addressed in alternating column pairs in individual rows based on odd/even time slots in accordance with the present invention.
Figure 12:
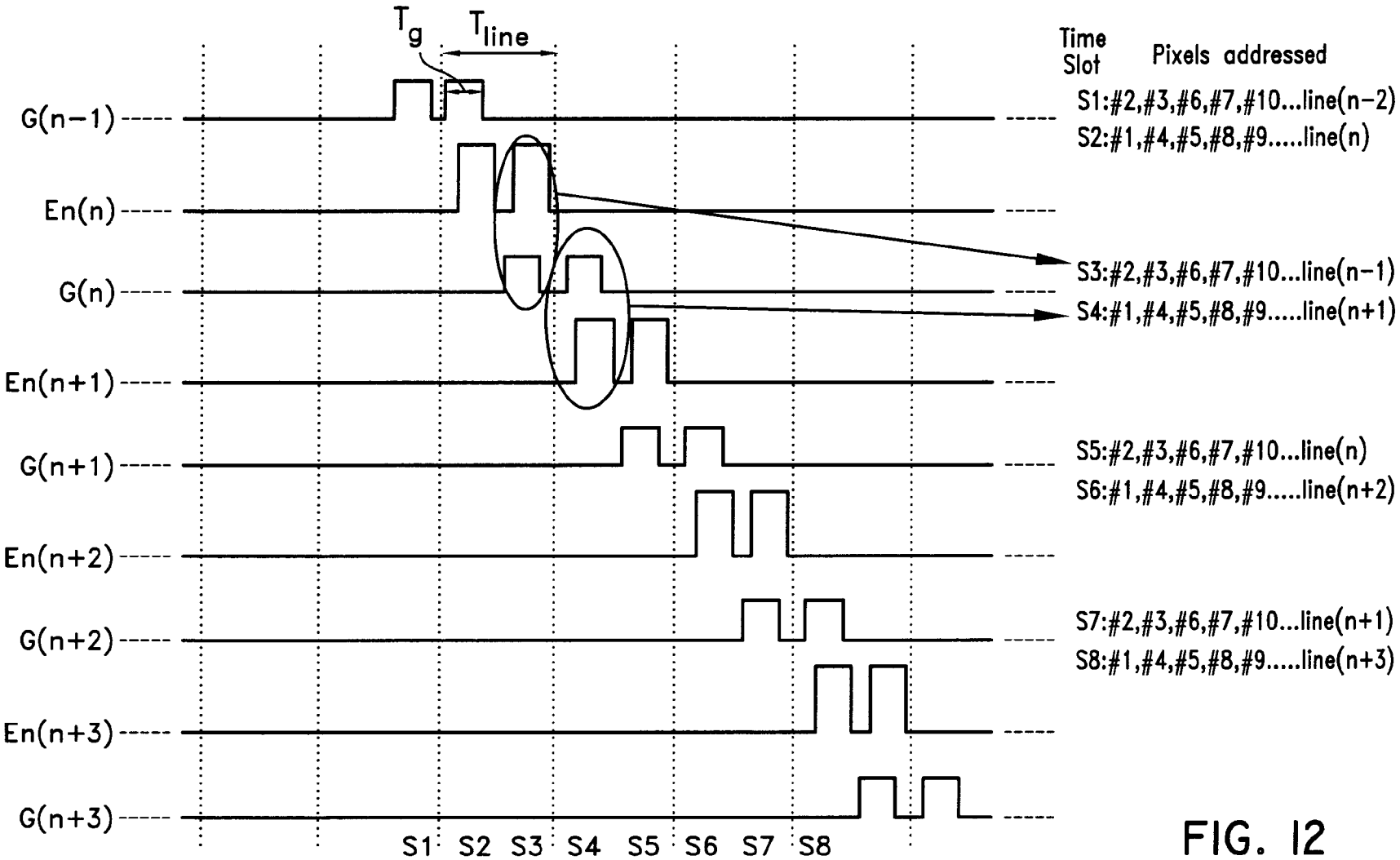
FIG. 12 is a timing diagram for the pixel addressing map of FIG. 11 in accordance with the present invention.

Referring to FIGS. 11 and 12, another driving method addresses half of the pixels in a first set of alternate column pairs, and the second half of the pixels in a second set of alternate column pairs as indicated. This is preferably performed by using a driving scheme that sequentially addresses all gate rows (G) with a double pulse and sequentially addresses all enable lines with a double pulse. A first gate pulse corresponds to the same time slot as a previous enable line, and a second gate pulse corresponds to the same time slot as the next enable line, as shown in the circled areas of FIG. 12. It is preferable that the gate drivers run with a frequency of $f=1/T_{line}$ and with OE control to achieve low levels between the double pulses. $T_{line}$ is preferably two time slots long as shown, and $T_g$ is the gate pulse width.

The array structure may be described by the following formula:

Addressed_display_row#=[(FLAG1)XOR(FLAG2)*[GATE_LINE#−(FLAG1)+(FLAG2)]

where FLAG1=(GATE_LINE#=ENABLE_LINE#)
and FLAG2=(GATE_LINE#=ENABLE_LINE#−1).

Without precharge for horizontal and vertical line inversion (i.e., polarity inversion as is known in the art) flags 1 and 2 equal to 1 are not permitted.

Figure 13:
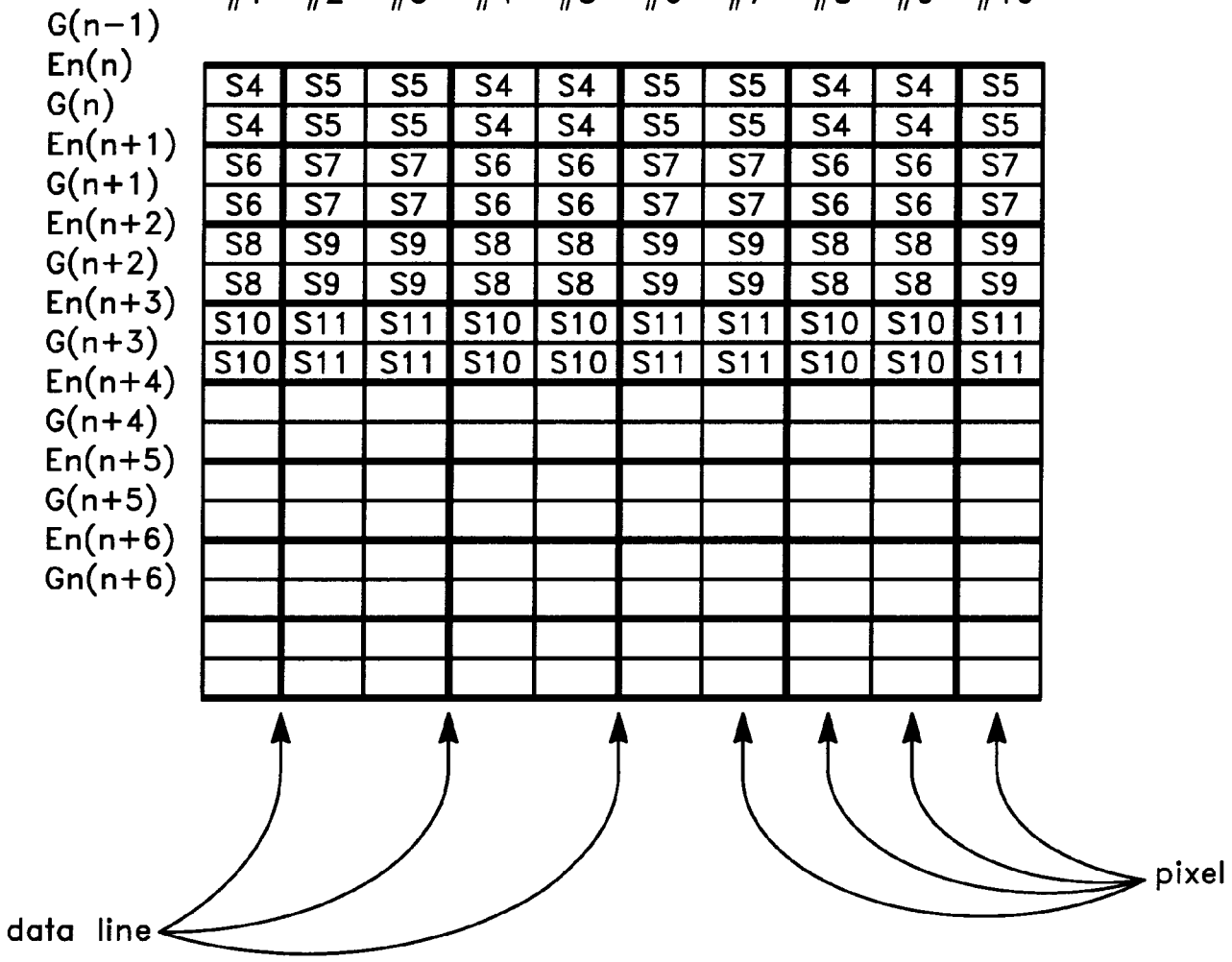
FIG. 13 is a pixel address map showing subpixels addressed in alternating column pairs for each row based on odd/even time slots in accordance with the present invention.
Figure 14:
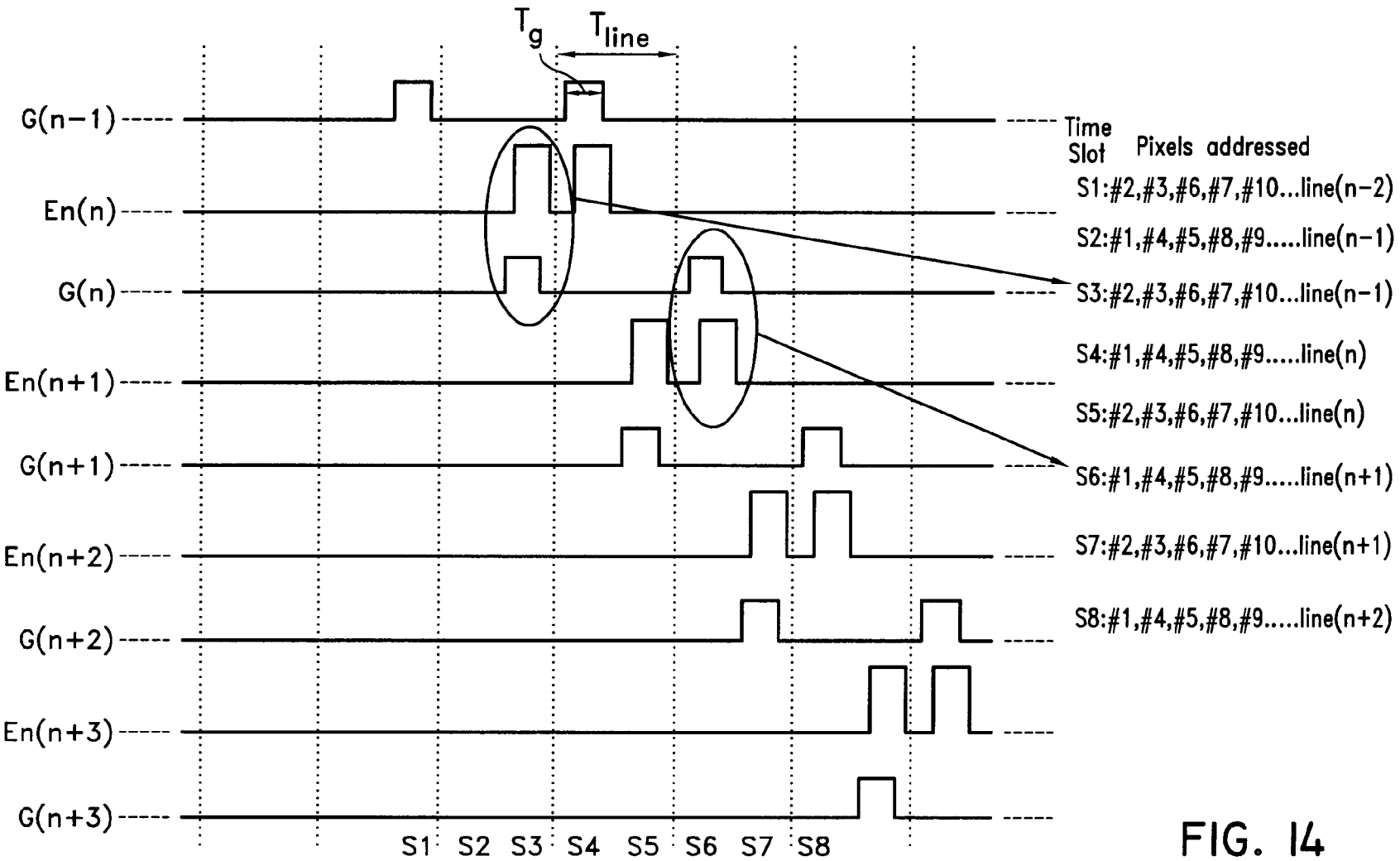
FIG. 14 is a timing diagram for the pixel addressing map of FIG. 13 in accordance with the present invention.

Referring to FIGS. 13 and 14, another driving method addresses half of a row of pixels in a first set of alternate column pairs of pixels during an even time slot, and the second half of the pixels in a second set of alternate column pairs of the same row during the odd time slot. The addressing is sequentially repeated for the rows following thereafter. This is preferably performed by using a driving scheme that sequentially addresses all gate rows (G) with a double pulse separated by two time slots of zero amplitude. The enable lines are also sequentially double pulsed. A first gate pulse corresponds in time with an enable pulse on the previous enable line, and a second gate pulse corresponds in time with an enable pulsed on a next enable line as indicated by the circled areas of FIG. 14. It is preferable that the gate drivers run with a frequency of $f=1/T_{line}$ and with OE control to achieve low levels between the double pulses. $T_{line}$ is preferably two time slots long as shown and $T_g$ is the gate pulse width. Without precharge for horizontal and vertical line inversion flags 1 and 2 equal to 1 are not permitted.

The driving methods of FIGS. 7–14 include alternating column pair sequencing and dot sequencing which provide several advantages. The alternating column pairs need less power to drive, while the dot pairs provide the lowest crosstalk configuration. Other driving schemes are contemplated in accordance with the represent invention. It is to be understood the FIGS. 7–14 may include precharge drivers to provide waveforms starting from a known state thereby providing a more reliable method. Precharging adds additional waveforms that are more complex and need more power than those shown in the FIGS.

It is also to be understood that the circuits described above may be implemented on a semiconductor device. Pixels may include a transmissive mode and a reflective mode. Transmissive mode includes modulating light from a surface of pixel by modulating a capacitive voltage to the pixel to transmit light directly therefrom. Reflective mode includes preparing the pixel to modulate light therefrom by reflecting light incident on its surface.

It is to be further understood that the present invention may be implemented with various semiconductor technologies, for example crystalline silicon, amorphous silicon, polysilicon, organic materials, Si—Ge and/or CDs. The embodiments of the present invention may be implemented on any active matrix display without impacting conventional fabrication processes. In preferred embodiments, the displays are used in lap top computers or other electronic devices having LCDs. Further, the present invention implements multiplexing/demultiplexing capability while reducing components and cost.

Having described preferred embodiments of driving method and circuit for pixel multiplexing circuits (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A driving method for multiplexing pixels in active matrix displays comprising steps of:

providing a plurality of pixels arranged in an array, wherein each pixel includes at least two transistors associated therewith, the transistors disposed in the array of pixels and each pixel including a plurality of control lines for controlling the transistors for turning each pixel on and off; and sequencing waveforms on the control lines to provide multiplexing of the pixels at the pixels within the array;

wherein the control lines include row lines connected to gates of one of the at least two transistors, and enable lines connected to gates of the other transistor of the at least two transistors, the row lines and enable lines being alternately disposed within the array of pixels and further comprising the step of:

providing waveforms on the enable lines having a fall time after a fall time of an adjacent row line wherein a difference in fall times ensures proper discharge and turn off of the gates of the transistors.

2. The driving method as recited in claim 1, wherein the control lines include enable and row lines and the step of sequencing waveforms further comprises the step of adjusting timing sequences of the waveforms wherein at least one pair of an adjacent enable line and row line are activated simultaneously to create a conducting path through the at least two transistors between a data line and a storage capacitor.

3. The driving method as recited in claim 1, further comprising the step of activating the control lines by employing a gate driver.

4. The driving method as recited in claim 3, wherein the gate driver includes a plurality of outputs and further comprises the step of connecting the outputs of the gate driver in parallel with a plurality of control lines.

5. The driving method as recited in claim 1, wherein the control lines include row lines and further comprising the steps of:

providing storage capacitors having a charging electrode and a counter electrode, the charging electrode coupled to one of the at least two transistors for each pixel and the counter electrode including a first row line; and compensating for feedthrough voltage on the storage capacitor by providing a negative pulse on the first row line while charging the charging electrode with a positive pulse on a second row line.

6. The driving method as recited in claim 1, wherein the control lines include row lines and further comprising the steps of:

providing storage capacitors having a charging electrode and a counter electrode, the charging electrode coupled to one of the at least two transistors for each pixel and the counter electrode including a first row line; and compensating for an effective value of a data line voltage by providing a negative pulse on the first row line while charging the charging electrode with a positive pulse on a second row line.

7. The driving method as recited in claim 1, wherein the control lines include row lines and further comprising the steps of:

providing storage capacitors having a charging electrode and a counter electrode, the charging electrode coupled to one of the at least two transistors for each pixel and the counter electrode including a first row line; and compensating for feedthrough voltage on the storage capacitor by providing a positive pulse on the first row line while charging the charging electrode with a negative pulse on a second row line.

8. The driving method as recited in claim 1, wherein the control lines include row lines and further comprising the steps of:

providing storage capacitors having a charging electrode and a counter electrode, the charging electrode coupled to one of the at least two transistors for each pixel and the counter electrode including a first row line; and compensating for an effective value of a data line voltage by providing a positive pulse on the first row line while charging the charging electrode with a negative pulse on a second row line.

9. The driving method as recited in claim 1, further comprising the step of adjusting signal delay on controls lines between pixels.

10. The method as recited in claim 1, wherein the step of sequencing waveforms includes the step of addressing half of the pixels in a first time subframe and a second half of the pixels in a second time subframe.

11. The method as recited in claim 1, wherein the array includes columns of pixels and the method further comprises the step of addressing the pixels in a first set of alternating column pairs of pixels in a first set of time slots and addressing a second set of alternating column pairs of pixels in a second set of time slots such that all pixels in the array are addressed in the first and second sets of time slots.

12. The method as recited in claim 11, wherein the array includes rows of pixels and the method further comprising the step of addressing the pixels in the alternating column pairs for each pair of rows of pixels.

13. The method as recited in claim 1, wherein the array includes columns of pixels and the method further comprising the step of addressing the pixels in a first set of alternating column pairs of pixels in a first time subframe and addressing a second set of alternating column pairs of pixels in a next consecutive time subframe such that all pixels in the array are addressed in the first and next consecutive time subframes.

14. The method as recited in claim 1, wherein pixels are grouped in dot pairs and the method further comprising the step of addressing the pixels in a first half of dot pairs of pixels in a first time subframe and addressing a second half of dot pairs of pixels in a next consecutive time subframe such that all pixels in the array are addressed in the first and next consecutive time subframes.

15. A circuit for addressing pixels in a pixel array comprising:

at least two transistors associated with each pixel, the transistors disposed in the array of pixels;

a plurality of control lines for each pixel which control the transistors of each pixel; and at least one gate driver which sequences waveforms on the control lines to provide multiplexing of the pixels at the pixels within the array, wherein the control lines include row lines connected to gates of one of the at least two transistors and enable lines connected to gates of another transistor of the at least two transistors, the row lines and enable lines being alternately disposed within the array of pixels and shared between adjacent rows of pixels.

16. The circuit as recited in claim 15, wherein the control lines include enable and row lines such that at least one pair of an adjacent enable line and row line are activated simultaneously to create a conducting path, through the at least two transistors, between a data line and a storage capacitor.

17. The circuit as recited in claim 15, wherein the gate driver includes a semiconductor chip.

18. The circuit as recited in claim 15, wherein the gate driver includes a plurality of outputs and the outputs of the gate driver are connected in parallel with a plurality of control lines.

19. The circuit as recited in claim 15, wherein the at least two transistors include thin film transistors.

20. The circuit as recited in claim 15, wherein the circuit includes two gate drivers.

21. The circuit as recited in claim 15, wherein the at least one gate driver has outputs split into a first group and a second group such that a duty cycle and a capacitive load for the outputs is reduced by one half.

22. The circuit as recited in claim 15, wherein the circuit for addressing pixels includes an integrated circuit.

23. A driving method for multiplexing pixels in active matrix displays comprising steps of:

providing a plurality of pixels arranged in an array, wherein each pixel includes at least two transistors associated therewith, the transistors disposed in the array of pixels and each pixel including a plurality of control lines for controlling the transistors for turning each pixel on and off;

sequencing waveforms on the control lines to provide multiplexing of the pixels at the pixels within the array, wherein the control lines include row lines;

providing storage capacitors having a charging electrode and a counter electrode, the charging electrode coupled to one of the at least two transistors for each pixel and the counter electrode including a first row line; and compensating for feedthrough voltage on the storage capacitor by providing a negative pulse on the first row line while charging the charging electrode with a positive pulse on a second row line.

24. A driving method for multiplexing pixels in active matrix displays comprising steps of:

providing a plurality of pixels arranged in an array, wherein each pixel includes at least two transistors associated therewith, the transistors disposed in the array of pixels and each pixel including a plurality of control lines for controlling the transistors for turning each pixel on and off;

sequencing waveforms on the control lines to provide multiplexing of the pixels at the pixels within the array, wherein the control lines include row lines;

providing storage capacitors having a charging electrode and a counter electrode, the charging electrode coupled to one of the at least two transistors for each pixel and the counter electrode including a first row line; and compensating for an effective value of a data line voltage by providing a negative pulse on the first row line while charging the charging electrode with a positive pulse on a second row line.

25. A driving method for multiplexing pixels in active matrix displays comprising steps of:

providing a plurality of pixels arranged in an array, wherein each pixel includes at least two transistors associated therewith, the transistors disposed in the array of pixels and each pixel including a plurality of control lines for controlling the transistors for turning each pixel on and off; and sequencing waveforms on the control lines to provide multiplexing of the pixels at the pixels within the array, wherein the control lines include row lines;

providing storage capacitors having a charging electrode and a counter electrode, the charging electrode coupled to one of the at least two transistors for each pixel and the counter electrode including a first row line; and compensating for feedthrough voltage on the storage capacitor by providing a positive pulse on the first row line while charging the charging electrode with a negative pulse on a second row line.

26. A driving method for multiplexing pixels in active matrix displays comprising steps of:

providing a plurality of pixels arranged in an array, wherein each pixel includes at least two transistors associated therewith, the transistors disposed in the array of pixels and each pixel including a plurality of control lines for controlling the transistors for turning each pixel on and off;

sequencing waveforms on the control lines to provide multiplexing of the pixels at the pixels within the array, wherein the control lines include row lines;

providing storage capacitors having a charging electrode and a counter electrode, the charging electrode coupled to one of the at least two transistors for each pixel and the counter electrode including a first row line; and compensating for an effective value of a data line voltage by providing a positive pulse on the first row line while charging the charging electrode with a negative pulse on a second row line.

* * * * *